United States Patent [19]

Sollinger et al.

[11] Patent Number: 4,834,018

[45] Date of Patent: May 30, 1989

[54] DEVICE FOR COATING TRAVELING MATERIAL WEBS

[75] Inventors: Hans-Peter Sollinger; Hans-Joachim Fissmann; Hans Weisz, all of Heidenheim, Fed. Rep. of Germany; Franz Krautzberger, deceased, late of Groszkuchen, Fed. Rep. of Germany, by Anni Krautzberger, administrator; Albert Woehrle, deceased, late of Heidenheim, Fed. Rep. of Germany, by Ingrid Woehrle, administrator

[73] Assignee: J. M. Voith, GmbH, Heidenheim, Fed. Rep. of Germany

[21] Appl. No.: 165,455

[22] Filed: Mar. 1, 1988

Related U.S. Application Data

[63] Continuation of Ser. No. 788,464, Oct. 17, 1985, abandoned.

[30] Foreign Application Priority Data

Oct. 19, 1984 [DE] Fed. Rep. of Germany ..... 3438380

[51] Int. Cl.[4] ..... B05C 5/00

[52] U.S. Cl. ..... 118/410; 427/356

[58] Field of Search ..... 118/407, 410, 413; 427/356, 358

[56] References Cited

U.S. PATENT DOCUMENTS

| | | | |
|---|---|---|---|
| 3,150,997 | 9/1964 | Pelletier et al. | 118/407 |
| 3,345,803 | 10/1967 | Smith | 118/610 X |
| 4,398,494 | 8/1983 | Alheid | 118/413 X |
| 4,503,804 | 3/1985 | Damrau | 118/410 |

FOREIGN PATENT DOCUMENTS

| | | | |
|---|---|---|---|
| 95770 | 2/1973 | Fed. Rep. of Germany | 118/410 |
| 770560 | 10/1980 | U.S.S.R. | 118/411 |

*Primary Examiner*—Shrive Beck
*Assistant Examiner*—Alain Bashore
*Attorney, Agent, or Firm*—Albert L. Jeffers; Richard L. Robinson

[57] ABSTRACT

A coating device where the pressurized coating space formed between the doctor element and the material web and/or the counter roll carrying it is defined by a regulating plate on the inlet side relative to the material web. A guide device is so arranged in the coating space that coating mixture will circulate around it on all sides in one direction of rotation. The guide device generally leaves only relatively narrow flow channels open in the coating chamber so that harmful turbulent flows are extensively avoided which through pulsating air inclusions might lead to defects in the applied coating.

10 Claims, 3 Drawing Sheets

DEVICE FOR COATING TRAVELING MATERIAL WEBS

This is a continuation of application Ser. No. 788,464, filed Oct. 17, 1985, now abandoned.

BACKGROUND OF THE INVENTION

The invention is directed to a device for coating traveling material webs, and more specifically, the invention is directed at such device having a pressurized coating space formed between a doctor element, a counter roll carrying a material web and a discharge opening of a chamber for the coating mixture wherein a guide device is arranged in the coating space with the coating material flowing around the guide device.

A coating device for coating a traveling material web is shown in DT-PS 95 770. With such a coating device, the coating mixture proceeds from a chamber in which it is first held as in a reservoir through a slot or gap type outlet opening of the chamber into a coating space in which the coating mixture continues to be held under pressure. The coating space is formed on the material web and/or the counter roll carrying it and is defined relative to these by a front regulating plate, the mouth of the chamber outlet opening, and by the doctor element. In the process, the coating mixture can discharge from the coating space against the direction of travel of the web through a choking gap formed between a front regulating plate and the counter roll and/or the material web. This generally prevents air from being introduced into the coating space through the material web.

Air inclusions in the coating have the disadvantage of producing a nonuniform coating such as a coating that includes striations. But a striated appearance of the coating is caused not only by air inclusions, but also, for example, by pulsations in the coating mixture flow or by stagnant or swirling boundary layers.

SUMMARY OF THE INVENTION

The problem to which the invention is directed is to provide a coating device wherein the danger of the presence of striations is further eliminated, and a maximally uniform coating is produced.

The installed guide device of the invention essentially prevents any unfavorable striation of longer duration. The invention further provides a great advantage in that the guide device requires no rotational drive.

The above-mentioned and other features and objects of this invention and the manner of attaining them will become more apparent and the invention itself will be best understood by reference to the following description of embodiments of the invention taken in conjunction with the accompanying drawings.

DETAILED DESCRIPTION OF SPECIFIC EMBODIMENTS

Figure 1:
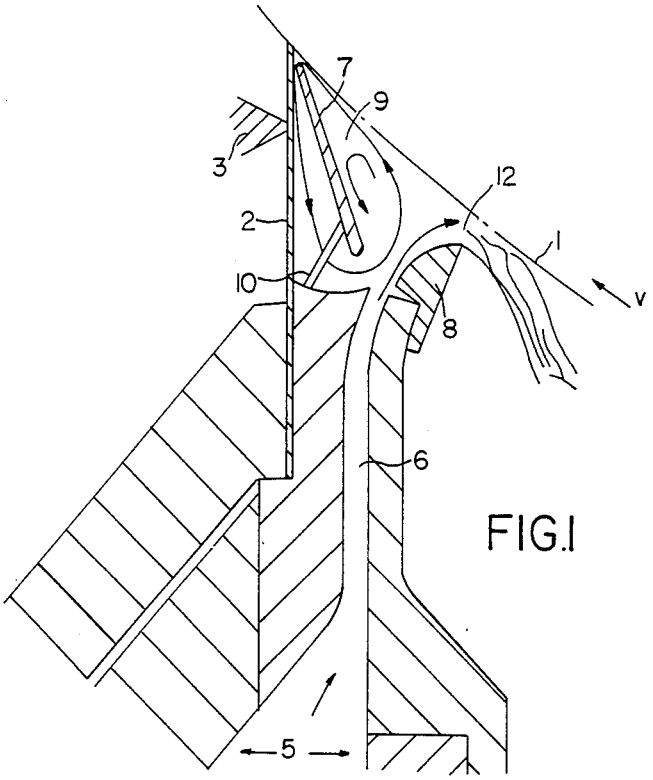
FIG. 1 is a cross-sectional view of a first specific embodiment of the invention.

In FIG. 1, a doctor plate 2 is in contact with the counter roll 1 carrying in this area a material web, such as, for example, a paper web. The doctor blade 2 is pressed on the counter roll by means of a pressure bar 3, and doctor blade 2 is held in a support 4. Also mounted on the support 4 is a chamber 5 for receiving the coating mixture, and from the mouth 6 of which the coating mixture proceeds to the coating space 9 which is formed between the mouth 6 of the chamber 5, the doctor blade 2, and the counter roll 1. On the inlet side of the coating space 9, that is, in regard of the inlet velocity of the material web marked by an arrow, the coating space is defined by a regulating plate 8. The upper end of the regulating plate 8 leaves a gap 12 with respect to the counter roll 1 through which the coating mixture can flow out of the coating space opposite to the direction of travel of the material web thereby preventing the material web from carrying air into the coating space 9. A flow guide device 7 is arranged in the coating space 9, and is held therein by lands 10 extending from one defining wall of the mouth of the chamber 5. Coating mixture flows around this guide device on all sides. The guide device extends between the mouth of the chamber 5 and the contact edge of the doctor blade 2 on the counter roll 1 and is spaced apart from the contact edge of the doctor blade and the counter roll.

The wall of the mouth located on the doctor blade 2 is so fashioned in the area bordering on the coating space 9 that the coating mixture returning from the doctor blade is so deflected that it will impinge on the coating mixture discharging from the mouth at a divergence angle which is considerably smaller than 90°. This angle as presently shown is about 20° to 40°. The one end of the guide device 7 is located approximately at the discharge end of the mouth 6. The discharge end of the mouth 6 points away from the doctor blade 2 in its section bordering on the coating space so that guide device 7 can be arranged approximately in the center of the coating space. Arrows in the coating space 9 indicate the flow conditions, and it can be seen that a certain small swirling area exists nevertheless.

Figure 2:
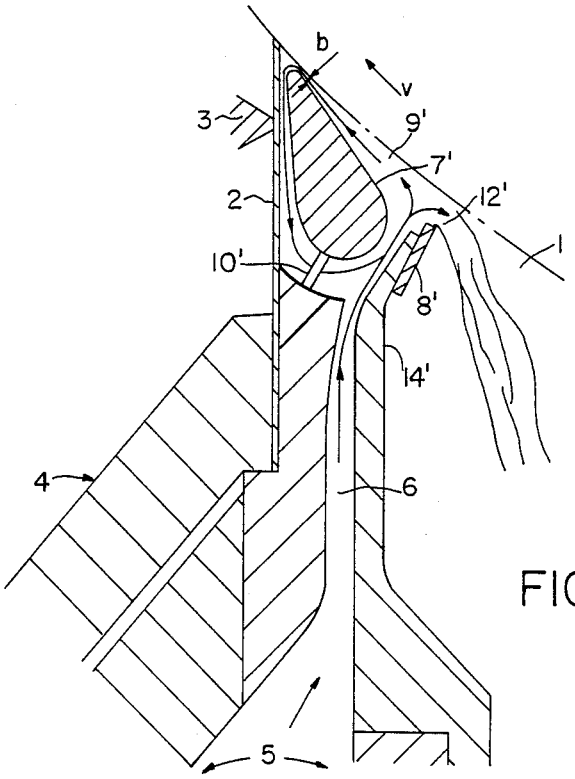
FIG. 2 is a cross-sectional view of a second specific embodiment of the invention.

Referring to FIG. 2, this swirling condition is further improved by using the guide device 7' wherein it is configured as shown with a very thick and aerodynamic, drop-shaped design wherein at the contact edge of the doctor blade 2 there is a point and a heavy round portion at the other end. Here again, the mouth 6 points away from the doctor blade 2 so that the thick end of the guide device 7' opposite its point will be located approximately at the discharge opening of the mouth 6. In addition, the returning coating mixture is deflected in the area of the mouth section located at the coating space as can be seen from FIG. 2.

Figure 3:
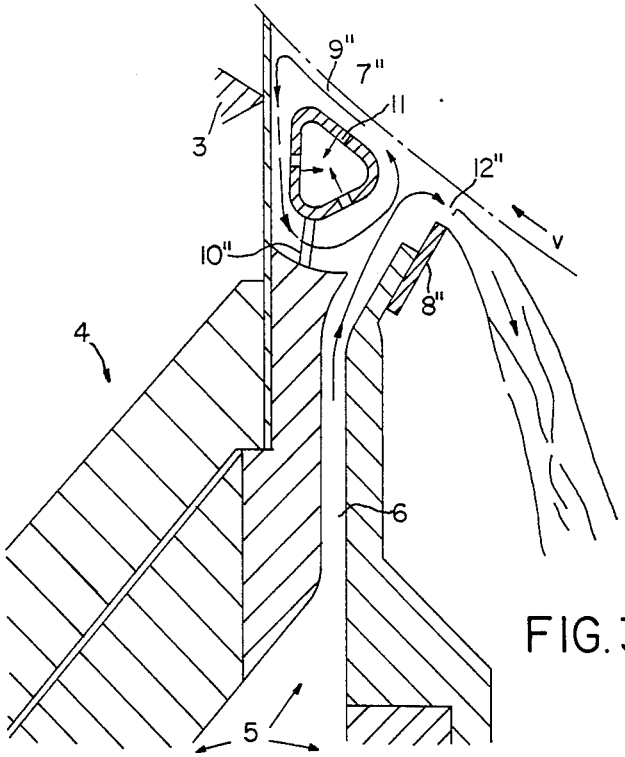
FIG. 3 is a cross-sectional view of a third specific embodiment of the invention.

In FIG. 3, the guide device 7'' has a hollow design and is provided with various bores 11 in its outside walls which are evenly distributed across the circumference and length of the guide device 7'' so as to suck in air which accumulates at the surface of the guide device.

Figure 4:
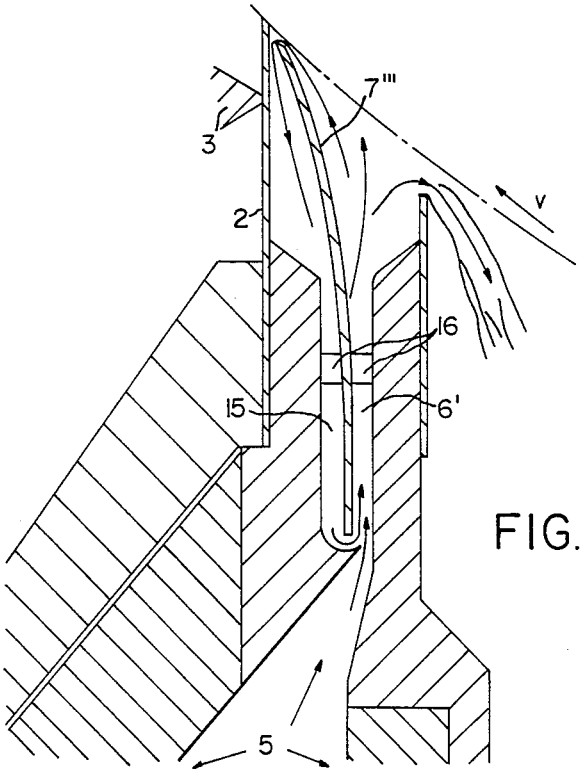
FIG. 4 is a cross-sectional view of a fourth specific embodiment of the invention.

In FIG. 4 there is presented another specific embodiment wherein the guide device 7''' is designed as a vane which at its bottom end defines the mouth 6' of the chamber 5 on one side. Located on the other side of the vane is a return channel 15 for the coating mixture removed by the doctor blade 2 and which, in turn, is so deflected at the bottom end of the guide device that it will impinge on the coating mixture discharging from the chamber 5 at a maximum divergence angle of 30°.

There is obtained through this design employing the vane 7''' an injector effect at the bottom end thereof because the coating mixture entering the mouth 6' from the chamber 5 flowing to the application zone practically sucks up the coating mixture removed by the doctor blade 2. By this suction, the returning coating is prevented from remaining for a longer time in the area of the doctor blade, and possibly lumping there or causing other interferences, such as, for example striation. This injector effect applies in a certain way to the other specific embodiments and is very advantageous.

Figure 5:
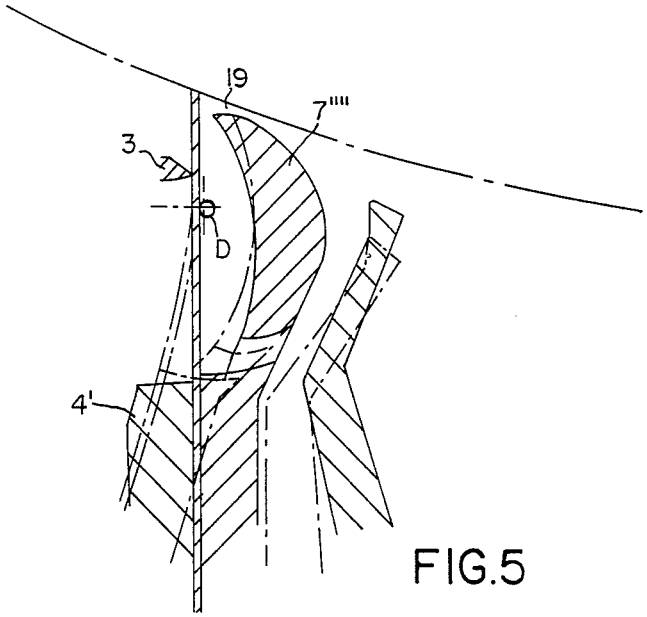
FIG. 5 is a cross-sectional view of a fifth specific embodiment of the invention; and FIGS. *6a* and *6b* illustrate two specific variances of the discharge openings contained in guide device of FIG. 3.

FIG. 5 presents a specific embodiment wherein the guide 7'''' is attached to the support 4' of the doctor blade 2' and pivots with it. To keep the gap 19 which is formed relative to the material web and/or the counter roll at the point of the guide device 7'''' constant, the guide device features at this point on its surface facing the counter roll a radius whose center coincides with the virtual swivel axis D of the support 4' of the doctor blade 2. When pivoting on this virtual swivel axis (indicated by broken lines), the doctor blade 2' is being forced more heavily on the pressure bar 3 and is deformed correspondingly. But the position of the part of the doctor blade 2' extending from the pressure bar 3 to the counter roll remains essentially unchanged in the process. A coating device enabling this to occur is taught, for example, by the German Patent Publication 32 36 755.

In the case of the embodiments according to FIG. 2, or also FIG. 4, the gap 19 between the guide device and the counter roll is so dimensioned that the coating mixture will be subjected to a sufficient shear so as to be homogeneous in its consistency. A prerequisite is that the distance "b" of gap 19 will be smaller than the result of the condition $b=v/10^3$, where v represents the velocity of the material web in m/s. When giving the gap a width of, for example, 2 to 4 mm it will be sufficiently small to easily meet this condition.

In the case of guide devices such as those in FIGS. 2 and 3, the injector effect of the coating mixture discharging from the mouth 6, with regard to the returning coating mixture removed by the doctor blade can be seen from the flow arrows. By such guide devices (7', 7'') there is accomplished thereby a flow which is even more favorable because it is smooth. The same effect is achieved with guide device 7''' in FIG. 4; and further, there is the presence of an additional advantage of a long mixing zone in the mouth 6' of the chamber 5.

In the case of the specific embodiment of FIG. 4, the position of the guide device 7''' in the mouth 6' is fixed best by means of spacer plates 16.

Figure 6A:
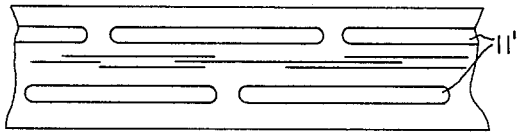
Figure 6B:
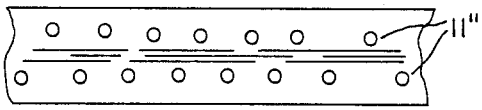

Instead of sucking air and coating mixture into the central guide device 7'' according to FIG. 3 so as to remove air from the application zone, it is possible to use the guide device to introduce coating mixture through the central guide elements 7'' into the application zone, which mixture would then discharge through the openings 11. This introduction of coating mixture will as well prevent the formation of a boundary layer through which occur unfavorable conditions of flow and/or aging coating mixture problems. There are presented in FIGS. 6a and 6b variants of the discharge openings. According to FIG. 6a, the discharge openings are slots 11' in a linear arrangement with intervening lands. In FIG. 6b, the discharge openings are bores 11'' mutually offset in two rows.

While there have been described above the principles of this invention in connection with specific apparatus, it is to be clearly understood that this description is made only by way of example and not as a limitation to the scope of the invention.

What is claimed is:

1. In a coating device, the combination comprising:

a doctor element having a contact edge;

a rotary counter roll carrying thereon a material web to be coated;

means defining a coating mixture chamber with a discharge opening;

said doctor element, counter roll and discharge opening of said chamber cooperating to define a pressurized coating space, said discharge opening communicating between said coating mixture chamber and said coating space, said discharge opening providing flow of coating mixture into said coating space; and a flow guide device fixed within the coating space and generally extending longitudinally along said rotary counter roll and transversely across said coating space, said flow guide device having an essentially pointed leading portion adjacent the contact edge of the door element and said counter roll, which flow guide and counter roll cooperate to define a tapered gap therebetween, which gap diminishes in width in a direction toward the contact edge of the doctor element, said gap being smallest at the leading portion and having a value in meters considerably smaller than the value deriving from the formula $v/10^3$ where v represents the web velocity in meters/second;

said flow guide device spaced from said mixture chamber discharge opening, counter roll and doctor element to define a channel for the flow of the coating mixture in one direction around said guide device and through said gap.

2. The coating device according to claim 1 wherein said guide device leaves only narrow flow channels open both between itself and the doctor element and between itself and the material web.

3. The coating device according to claim 1, further comprising:

a regulating plate defined on a side of the coating space facing away from the doctor element and leaving open a narrow flow channel between itself and the material web.

4. The coating device according to claim 1 wherein the guide device has in cross section a smooth flow profile.

5. The coating device according to claim 1 wherein the guide device is drop-shaped in cross-section.

6. In a coating device, the combination comprising:

a doctor element having a contact edge;

a rotary counter roll carrying thereon a material web to be coated;

means defining a coating mixture chamber with a discharge opening;

said doctor element, counter roll and mixture chamber discharge opening cooperating to define a pressurized coating space, said mixture chamber discharge opening communicating between and providing flow of coating mixture between said mixture chamber and said coating space;

a flow guide device fixed within the coating space, extending longitudinally along said counter roll and extending transversely across said coating space between, and spaced from, the mixture chamber discharge opening, the counter roll and the contact edge of the doctor element, said flow guide device cooperating with the counter roll to define a channel for the flow of the coating mixture around said guide device in one direction;

said flow guide device having an essentially pointed leading portion adjacent the contact edge of the doctor element and the counter roll, which flow guide and counter roll cooperate to define a tapered gap therebetween, which gap diminishes in width in a direction toward the contact edge of the doctor element, said gap being smallest at the leading portion and having a value in meters considerably smaller than the value deriving from the formula $v/10^3$ where v represents the web velocity in meters/second;

said doctor element operable to remove excess coating mixture from said web;

said means defining said coating mixture chamber defining a mouth surrounding said discharge opening of said chamber, a portion of said mouth disposed adjacent to the doctor element, said portion of said mouth contoured to correspond to the shape of the guide device and to define a smooth flow channel for deflecting the excessive coating mixture removed by the doctor element and returning said excess coating to the proximity of said discharge opening at a divergence angle of less than ninety degrees to the coating mixture flow issuing from the discharge opening.

7. The coating device as claimed in claim 6 wherein said guide device has a portion furthest from said doctor element, said discharge opening at said coating space being adjacent said guide device furthest portion and cooperating with the mixture chamber mouth to deflect the coating mixture flow from said mixture chamber, through the smooth flow channel between said guide device and counter roll, toward the contact edge of said doctor element.

8. In a coating device, the combination comprising:

a doctor element having a contact edge;

a rotary counter roll carrying thereon a material web to be coated;

means defining a coating mixture chamber with a discharge opening;

said doctor element, counter roll and mixture chamber discharge opening cooperating to define a pressurized coating space therebetween, said mixture chamber discharge opening communicating between and providing flow of coating mixture between said mixture chamber and said coating space; and a flow guide device fixed within the coating space, extending longitudinally along said counter roll, extending transversely across said coating space between, and spaced from the mixture chamber discharge opening, the counter roll and the contact edge of the doctor element;

said flow guide device cooperating with the counter roll to define a channel for the flow of the coating mixture around said guide device in once direction;

said flow guide device having an essentially pointed leading portion adjacent the contact edge of the doctor element and the counter roll, which flow guide and counter roll cooperate to define a tapered gap therebetween, which gap diminishes in width in a direction toward the contact edge of the doctor element, said gap being smallest at the leading portion and having a value in meters considerably smaller than the value deriving from the formula $v/10^3$ where v represents the web velocity in meters/second;

said doctor element operable to remove excess coating mixture from said web;

said flow guide device having a substantially flat plate-shaped design with a doctor-element side facing toward said doctor element, a mixture-chamber side facing away from the doctor element, and a lower end in proximity to said mixture chamber, said mixture-chamber side and said means defining said mixture chamber cooperating to define a mouth of the coating mixture chamber, said doctor-element side cooperating with the doctor element and the means defining the coating mixture chamber to define a lower end injector region and a channel for returning the excess coating mixture removed by the doctor element to the mixture chamber and mouth region, said coating mixture flowing from said mixture chamber to said coating space providing an injector suction effect on said excess coating mixture in said channel and injector region.

9. In a coating device, the combination comprising:

a doctor element having a contact edge;

a rotary counter roll carrying thereon a material web to be coated;

means defining a coating mixture chamber with a discharge opening;

said doctor element, counter roll and discharge opening of said chamber cooperating to define a pressurized coating space, said discharge opening communicating between said coating mixture chamber and said coating space, said coating space; and a flow guide device fixed within the coating space and generally extending longitudinally along said rotary counter roll and transversely across said coating space, said flow guide device being hollow and having outside walls containing evenly distributed holes for sucking off gases which have penetrated the coating mixture or for introducing coating mixture into the coating space;

said flow guide device having a leading portion gradually tapering toward said counter roll, which flow guide leading portion and counter roll cooperate to define a gap therebetween, wherein the smallest width of said gap has a value considerably smaller than the value deriving from the formula $v/10^3$ where v represents the web velocity in meters/second, which gap is adjacent to said doctor element contact edge;

said flow guide device spaced from said mixture chamber discharge opening, counter roll and doctor element to define a channel for the flow of the coating mixture in one direction around said guide device and through said gap.

10. In a coating device, the combination comprising:

a doctor element having a contact edge;

a hold-down element for the doctor element;

a rotary counter roll carrying thereon a material web to be coated;

means defining a coating mixture chamber with a discharge opening;

a doctor element support for supporting said doctor element, which support is connected to said means defining said coating mixture chamber;

a virtual swivel axis for said doctor element support, which swivel axis is arranged near said contact line;

said doctor element, counter roll and discharge opening of said chamber cooperating to define a pressurized coating space, said discharge opening communicating between said coating mixture chamber and said coating space, said discharge opening providing flow of coating mixture into said coating space; and a flow guide device fixed within the coating space and generally extending longitudinally along said rotary counter roll and transversely across said coating space, said flow guide device connected to said doctor element support, which guide device includes a curved surface facing the counter roll near the contact edge of the doctor element, said curved surface having a radius of curvature with a center, which center is located on the swivel axis of the doctor element support;

said flow guide device having a leading portion gradually tapering toward said counter roll, which flow guide leading portion and counter roll cooperate to define a gap therebetween, wherein the smallest width of said gap has a value considerably smaller than the value deriving from the formula $v/10^3$ where v represents the web velocity in meters/second, which gap is adjacent to said doctor element contact edge;

said flow guide device spaced from said mixture chamber discharge opening, counter roll and doctor element to define a channel for the flow of the coating mixture in one direction around said guide device and through said gap.

* * * * *

UNITED STATES PATENT AND TRADEMARK OFFICE

CERTIFICATE OF CORRECTION

PATENT NO. : 4,834,018

DATED : May 30, 1989

INVENTOR(S) : Hans-Peter Sollinger

It is certified that error appears in the above-identified patent and that said Letters Patent is hereby corrected as shown below:

Claim 8, Col. 5, line 68, change "once" to --one--;

Claim 9, Col. 6, line 43, after "space," insert --said discharge opening providing flow of coating mixture into--.

Signed and Sealed this

Twenty-seventh Day of February, 1990

*Attest:*

JEFFREY M. SAMUELS

*Attesting Officer*

*Acting Commissioner of Patents and Trademarks*